US009655412B2

(12) United States Patent
Nanbu et al.

(10) Patent No.: US 9,655,412 B2
(45) Date of Patent: May 23, 2017

(54) SIDE RELEASE BUCKLE

(71) Applicant: YKK Corporation, Tokyo (JP)

(72) Inventors: Madoka Nanbu, Toyama (JP); Ryoichiro Uehara, Toyama (JP)

(73) Assignee: YKK Corporation (JP)

( * ) Notice: Subject to any disclaimer, the term of this patent is extended or adjusted under 35 U.S.C. 154(b) by 5 days.

(21) Appl. No.: 14/675,624

(22) Filed: Mar. 31, 2015

(65) Prior Publication Data

US 2015/0201714 A1 Jul. 23, 2015

Related U.S. Application Data

(63) Continuation of application No. 13/498,999, filed as application No. PCT/JP2009/067042 on Sep. 30, 2009.

(51) Int. Cl.
*A44B 11/25* (2006.01)
*A44B 11/26* (2006.01)

(52) U.S. Cl.
CPC ..... *A44B 11/266* (2013.01); *A44B 11/2534* (2013.01); *Y10T 24/45492* (2015.01);
(Continued)

(58) Field of Classification Search
CPC ..... A44B 11/266; A44B 11/2534; Y10T 24/45492; Y10T 24/45524; Y10T 24/45529; Y10T 24/45581
See application file for complete search history.

(56) References Cited

U.S. PATENT DOCUMENTS 5,222,279 A 6/1993 Frano et al.
5,546,642 A 8/1996 Anscher
(Continued)

FOREIGN PATENT DOCUMENTS

CN 2865372 Y 2/2007
JP 2-52609 4/1990
(Continued)

OTHER PUBLICATIONS

Non-Final Office Action, U.S. Appl. No. 13/498,999, Jan. 24, 2014, 9 pages.
(Continued)

*Primary Examiner* — Robert J Sandy
*Assistant Examiner* — Michael Lee
(74) *Attorney, Agent, or Firm* — Kilpatrick Townsend & Stockton LLP

(57) ABSTRACT

A side release buckle includes: a plug; and a socket, the plug including: a base; a pair of legs; and engaging portions, the socket including: a body; an insertion opening; a housing space; engaged portions; and a pair of guide surfaces. The guide surfaces, which are formed on an inner surface of the housing space and extend in an insertion direction of the legs while being opposed to each other, each include: a squeezing portion formed continuously with corresponding one of the engaged portions; and a guiding portion formed between the squeezing portion and the insertion opening. An interval between the guiding portions-near the engaged portions is wider than an interval between the squeezing portions near the engaged portions. An inclination angle of each guiding portion to an insertion direction of the plug is smaller than an inclination angle of each of the squeezing portion to the insertion direction.

24 Claims, 11 Drawing Sheets

(52) U.S. Cl.
CPC .... *Y10T 24/45524* (2015.01); *Y10T 24/45529* (2015.01); *Y10T 24/45581* (2015.01)

(56) References Cited

U.S. PATENT DOCUMENTS

| | | | | |
|---|---|---|---|---|
| 7,100,252 | B2 | 9/2006 | Anscher | |
| D619,042 | S | 7/2010 | Uehara | |
| 8,112,850 | B2 | 2/2012 | Uehara | |
| 8,365,368 | B2 * | 2/2013 | Kaneko | A44B 11/266 24/193 |
| 2007/0186394 | A1 | 8/2007 | Hsiao | |
| 2009/0007391 | A1 | 1/2009 | Uehara | |
| 2009/0056089 | A1 | 3/2009 | Yoshie | |
| 2010/0306976 | A1 | 12/2010 | Kaneko et al. | |
| 2011/0173783 | A1 | 7/2011 | Kaneko | |
| 2012/0017407 | A1 | 1/2012 | Uehara et al. | |
| 2012/0030913 | A1 | 2/2012 | Uehara et al. | |
| 2012/0198666 | A1 | 8/2012 | Nanbu et al. | |
| 2012/0206474 | A1 | 8/2012 | Holland et al. | |
| 2012/0227222 | A2 | 9/2012 | Uehara et al. | |
| 2013/0025097 | A1 | 1/2013 | Uehara et al. | |
| 2013/0031754 | A1 | 2/2013 | Uehara et al. | |
| 2013/0091670 | A1 | 4/2013 | Nanbu et al. | |
| 2013/0117974 | A1 | 5/2013 | Kaneko et al. | |

FOREIGN PATENT DOCUMENTS

| | | |
|---|---|---|
| JP | 06-154013 | 6/1994 |
| JP | 6-154014 | 6/1994 |
| JP | 8-56710 | 3/1996 |
| JP | 1042912 | 2/1998 |
| JP | 1071008 | 3/1998 |
| JP | 2008178570 | 8/2008 |
| JP | 2009-011492 | 1/2009 |
| JP | 2009061050 | 3/2009 |
| KR | 20-1991-0005457 Y | 7/1991 |
| WO | 2010113368 | 10/2010 |

OTHER PUBLICATIONS

Final Office Action, U.S. Appl. No. 13/498,999, mailed Jul. 14, 2014, 14 pages.
Notice of Allowance, U.S. Appl. No. 13/498,999, Dec. 24, 2014, 7 pages.
Final Office Action, U.S. Appl. No. 13/647,320, mailed May 27, 2014, 13 pages.
Non-Final Office Action, U.S. Appl. No. 13/647,320, mailed Jan. 6, 2014, 13 pages.
Non-Final Office Action, U.S. Appl. No. 13/647,320, mailed Aug. 1, 2013, 16 pages.
International Search Report and Written Opinion, PCT International Application No. PCT/JP2009/067042, mailed Dec. 28, 2009.
International Preliminary Report on Patentability, PCT International Application No. PCT/JP2009/067042, mailed Jul. 10, 2012.
Office Action, Japanese Patent Application No. 2011-533996, mailed Apr. 30, 2013.
Office Action, Chinese Patent Application No. 200980161714.8, mailed Mar. 3, 2014.

* cited by examiner

SIDE RELEASE BUCKLE

RELATED APPLICATIONS

This application is a continuation of U.S. application Ser. No. 13/498,999 filed Mar. 29, 2012, now allowed, which is a national stage application of PCT/JP2009/067042 filed Sep. 30, 2009, both of which are incorporated herein by reference.

TECHNICAL FIELD

The present invention relates to a side release buckle that connects a belt and is provided with a pair of lock arms on both sides thereof.

BACKGROUND ART

There has been typically used a buckle that detachably engages a plug with a socket in order to couple a string member such as a belt in various applications such as clothes, bags, shoes and packages.

Such a buckle is required to be easily handled for coupling and releasing and not to cause an accidental release when the buckle is not intended to be released. As a product responding to such needs, a side release buckle including a pair of lock arms on both sides thereof has been used.

For instance, a side release buckle disclosed in Patent Literature 1 includes a plug and a socket, each of which is provided with a belt attachment.

The plug includes a base including the belt attachment and a pair of legs (lock arms) on both sides near the socket. The socket includes a hollow cylindrical body, which has a housing space (cavity) into which the plug is inserted through an insertion opening facing the plug.

Engaging portions formed at tip ends of the lock arms are engaged with engaged portions formed deep inside the housing space to maintain a coupling between the plug and the socket.

A pair of guide surfaces are formed on the inner surface of the housing space (the inside of the top and bottom surfaces of the socket), and extend from the insertion opening to the engaged portions while being opposed to each other so as to guide the engaging portions inserted through the insertion opening to the engaged portions.

The pair of guide surfaces, each of which is defined in a step on the inner surface of the socket, are linearly continuous from the insertion opening to the engaged portions. The pair of guide surfaces have an interval in a tapered shape therebetween, the interval being wider near the insertion opening and narrower near the engaged portions.

When tip ends of the plug are inserted into the socket through the insertion opening, the lock arms are smoothly guided into the housing space by the pair of guide surfaces. Subsequently, when the plug is pressed deep inside, the pair of engaging portions formed at the tip ends of the lock arms are squeezed in a direction to approach each other by the pair of guide surfaces while being guided to smoothly fit in the engaged portions. In this manner, the engaging portions can be easily and reliably engaged.

An opening in communication with the housing space is formed on each side of the body of the socket. The engaging portions and the engaged portions can be disengaged by manipulating the legs exposed through the openings by fingers.

In such a side release buckle, the plug and the socket each are integrally formed mainly of a synthetic resin material.

Accordingly, while the legs are provided with a predetermined elasticity, the plug, the socket and the belt attachment of each of the plug and the socket are provided with a sufficient strength to resist tension of the coupled belt in use.

CITATION LIST

Patent Literature

Patent Literature 1 JP-A-2009-11492

SUMMARY OF THE INVENTION

Problems to be Solved by the Invention

In the side release buckle disclosed in Patent Literature 1, when the lock arms of the plug are inserted into the socket, the pair of engaging portions are guided by the pair of guide surfaces while being squeezed, and then fit in the engaged portions. The guide surfaces disclosed in Patent Literature 1 define a continuous tapered shape from the insertion opening to the engaged portions. The guide surface on each side is linearly formed and is inclined at a predetermined inclination angle relative to an insertion direction of the plug.

Immediately after the engaging portions, which are to be squeezed by the guide surfaces, are inserted through the insertion opening, the engaging portions contact with the guide surfaces to receive a squeezing force. The engaging portions are pressed against the guide surfaces by a predetermined contact pressure based on a reaction force of deformation of the lock arms. In other words, the engaging portions are rubbed against the guide surfaces over quite a long distance, during which a squeak noise is frequently generated.

In particular, when an interval between both sides of the engaged portions is sufficiently reduced as compared with an interval between the engaging portions so as to improve the engaging performance, the squeezing force of the guide surfaces needs to be increased. Thus, the guide surfaces are required to start squeezing the engaging portions near the insertion opening. In an arrangement in which the guide surfaces start squeezing the engaging portions near the insertion opening, the engaging portions need to slide on the guide surfaces while receiving the squeezing force until reaching the engaged portions. As a result, a squeak noise is more likely to be generated.

Further, a resistance to the engaging portions is increased during the sliding motion of the engaging portions on the guide surfaces, so that the insertion of the plug is likely to stop before engagement. When the engaging portions stop halfway on the guide surfaces as described above, the engaging portions are kept squeezed (not completely squeezed) halfway on the guide surfaces, and thus the lock arms are kept deformed for a long time. Consequently, even when the plug is to be again coupled, the plug is unlikely to be normally coupled because of a deformation tendency remaining in the lock arms.

An object of the invention is to provide a side release buckle configured to allow engaging portions to slide on guide surfaces less forcefully while ensuring an appropriate guide function of the guide surfaces.

Means for Solving the Problems

According to an aspect of the invention, a side release buckle includes: a plug; and a socket into which the plug is inserted for engagement, in which the plug includes: a base;

a pair of legs that project from the base; and engaging portions that are formed at tip ends of the legs and project in a top-bottom direction, the socket includes: a body; an insertion opening that is formed in the body and through which the legs are inserted; a housing space in which the legs inserted through the insertion opening are housed; engaged portions that are engageable with the engaging portions formed at the tip ends of the legs housed in the housing space; and a pair of guide surfaces configured to guide the engaging portions inserted through the insertion opening to the engaged portions, the pair of guide surfaces are formed on an inner surface of the housing space and extend in an insertion direction of the legs while being opposed to each other, the pair of guide surfaces each including: a squeezing portion being formed continuously with corresponding one of the engaged portions; and a guiding portion being formed between the squeezing portion and the insertion opening, an interval between the guiding portions near the engaged portions is wider than an interval between the squeezing portions near the engaged portions, and an inclination angle of each of the guiding portions relative to an insertion direction of the plug is smaller than an inclination angle of each of the squeezing portions relative to the insertion direction of the plug.

In the above aspect, the pair of guide surfaces, each of which is generally defined in a step on the inner surface of the socket facing the housing space, are opposed to each other. For instance, the steps may be provided by increasing the thickness of the body of the socket in the vicinity of both sides thereof as compared with that in the vicinity of the central axis thereof. The side surfaces of the steps are usable as the guide surfaces. Alternatively, the steps may be provided by protrusions formed on the inner surface of the socket. The side surfaces of the protrusions (steps) are usable as the guide surfaces. Although the pair of guide surfaces are intended to be sufficiently wide to be resistant to the sliding motion of the engaging portions with contact pressure, each of the guide surfaces may have an appearance like a strip or a narrow rail such as a peripheral edge.

When each of the squeezing portions is provided by a linearly continuous step, the inclination angle of the squeezing portion is defined by an angle between a continuing direction of the step and the insertion direction of the plug. Likewise, when each of the guiding portions is provided by a linearly continuous step, the inclination angle of the guiding portion is defined by an angle between a continuation direction of the step and the insertion direction of the plug. When each of the squeezing portions is provided by a nonlinear step such as a curved step, the inclination angle of the squeezing portion may be approximately defined by an angle between a straight line connecting both ends of the squeezing portion and the insertion direction of the plug. Likewise, when each of the guiding portions is provided by a nonlinear step such as a curved step, the inclination angle of the guiding portion may be approximately defined by an angle between a straight line connecting both ends of the guiding portion and the insertion direction of the plug. The squeezing portions are required to be inclined in such a manner as to be spaced from each other at a narrower interval near the engaged portions and at a wider interval near the guiding portions.

The interval between the squeezing portions near the engaged portions is required to be sufficiently narrow for the pair of engaging portions to be squeezed to fit in the engaged portions. The interval between the guiding portions near the engaged portions may be wider than the interval between the squeezing portions near the engaged portions so that the guiding portions guide the engaging portions to the squeezing portions.

The engaged-portion sides of the guiding portions may be continuous with the squeezing portions. In this case, the interval between the guiding portions near the engaged portions may be equal to the interval between the squeezing portions near the insertion opening. The engaged-portion sides of the guiding portions may be discontinuous with the squeezing portions. As long as the engaged-portion sides of the guiding portions are spaced at a narrower interval than the engaged-portion sides of the squeezing portions, the engaging portions can be transferred to the squeezing portions when the plug is inserted. In either case, it is preferable that the minimum interval between the guiding portions is, for instance, wider than the interval between the pair of engaging portions with no load thereon so that the engaging portions receive no squeezing force, or, alternatively, the minimum interval is an interval for the engaging portions to be slightly squeezed.

In the above aspect, when the legs of the plug are inserted through the insertion opening of the socket and pressed in the insertion direction, the engaging portions at the tip ends of the legs are guided along the guide surfaces to fit in the engaged portions. Specifically, the engaging portions are guided deep inside the socket by the guiding portions, and then squeezed by the squeezing portions to fit in the engaged portions.

As compared with the squeezing portions, the guiding portions are spaced from each other at a wider interval over the entire length thereof, and are less inclined relative to the insertion direction, so that the guiding portions do not squeeze the engaging portions or may slightly squeeze the engaging portions. Thus, while being guided by the guiding portions, the engaging portions can slide with less resistance. As a result, it is possible to significantly lower a possibility of suffering from a deformation tendency resulting from the halfway stopping and generating a squeak noise.

The squeezing portions have an inclination angle and an interval determined such that the engaging portions having been guided by the guiding portions can be sufficiently squeezed to fit in the engaged portions. On the squeezing portions, the engaging portions may stop halfway, which may result in a deformation tendency, and generate a squeak noise. However, when the guiding portions having a large interval therebetween as a whole are formed over a part of a distance from the insertion opening to the engaged portions, it is possible to lower a possibility of suffering from a deformation tendency resulting from the halfway stopping and generating a squeak noise as a whole.

The sectional length of the squeezing portions is preferably, for instance, at most one third of the distance from the insertion opening to the engaged portions. Such sectional distribution can reduce the ratio of the sectional length of the squeezing portions to the distance from the insertion opening to the engaged portions. Thus, even though the engaging portions inevitably stop halfway on the squeezing portions, it is possible to significantly lower a possibility of suffering from a deformation tendency resulting from the halfway stopping and generating a squeak noise as a whole.

In the above aspect, the squeezing portions are formed over a short section with a steep inclination. Thus, when the plug is to be separated from the socket, the popping action of the plug can be enhanced with the assistance of the elastic repulsion of the lock arms for an easier separation.

Further, since the guide surfaces and the engaging portions provide a guiding function, it is not necessary to add any special guiding mechanism other than the legs to the plug, so that the weight and the costs of the plug can be reduced.

With the above arrangement, when the pair of legs are inserted into the housing space, the engaging portions at the tip ends of the legs are not squeezed by the guiding portions. Even when the engaging portions slide on the guiding portions depending on the insertion state of the legs, the engaging portions are not squeezed. Thus, it is possible to lower a possibility of suffering from a deformation tendency resulting from the halfway stopping and generating a squeak noise.

In the above aspect, it is preferable that the guide surfaces are parallel with each other along a direction of the guiding portions.

With the above arrangement, it is possible for the guiding portions to guide the engaging portions over a desired distance to the squeezing portions while keeping a constant relationship with the engaging portions. The guiding portions can thus increase the ratio of the guiding portions to the distance from the insertion opening to the engaged portions, so that it is possible to further lower a possibility of suffering from a deformation tendency resulting from the halfway stopping during insertion and generating a squeak noise.

In the above aspect, it is preferable that the guide surfaces each further include an introducing portion in addition to the squeezing portion and the guiding portion, the introducing portion is continuous with the insertion opening and the guiding portion, and an interval between the introducing portions near the insertion opening is wider than the interval between the guiding portions.

With the above arrangement, even when the interval between the guiding portions is smaller than the width of the insertion opening, the guiding portions and the insertion opening can be provided continuously with each other for smooth insertion of the engaging portions or legs.

In the above aspect, it is preferable that the guiding portions and the introducing portions are formed in conformity with an outer profile of the socket.

With the above arrangement, since the steps are formed in conformity with the outer profile of the socket, the interval between the steps can be maximized in the socket while the socket can have a thinner portion between the steps, which contributes to reducing the material and the weight of the socket.

DESCRIPTION OF EXEMPLARY EMBODIMENTS

Exemplary embodiments of the invention will be described below with reference to the attached drawings.

First Exemplary Embodiment

FIGS. 1 to 8 show a first exemplary embodiment of the invention.

Figure 1:
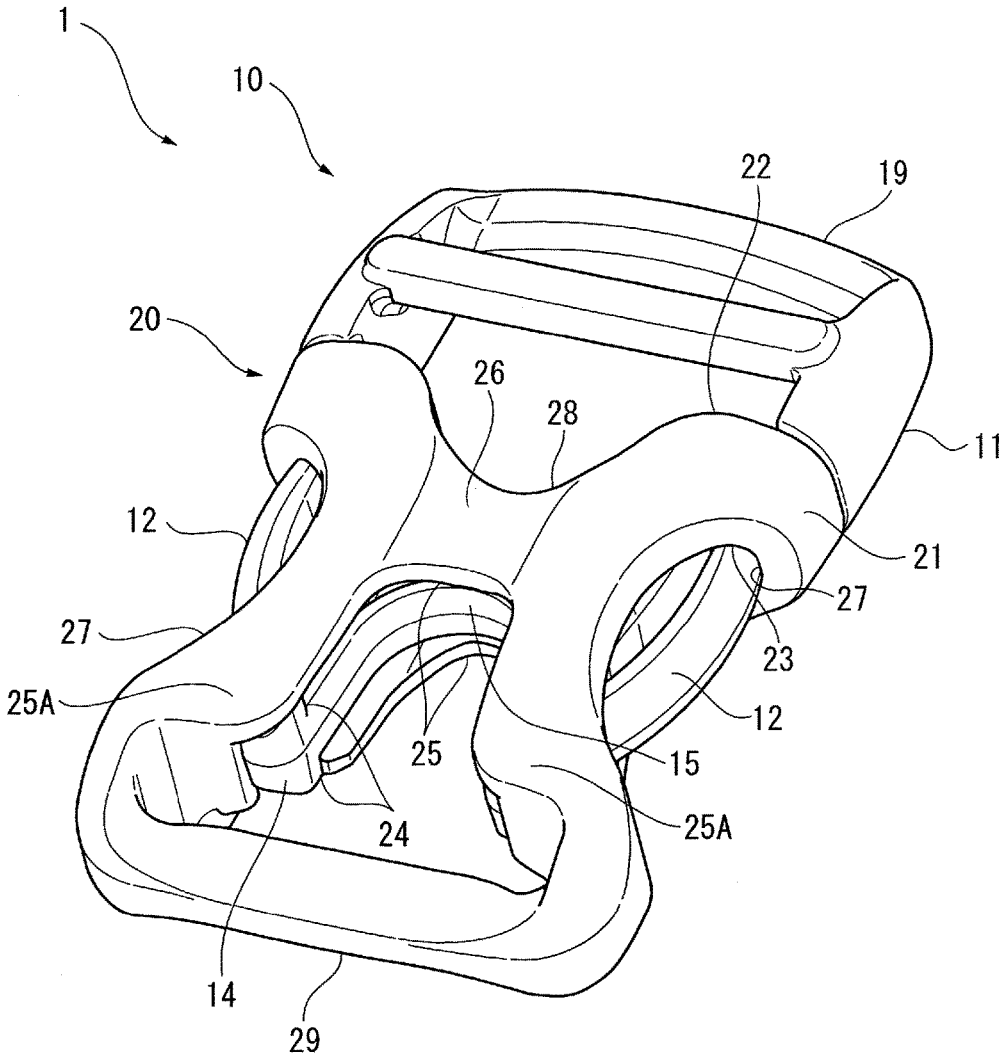
FIG. 1 is a perspective view showing a top surface of a buckle according to a first exemplary embodiment of the invention.
Figure 2:
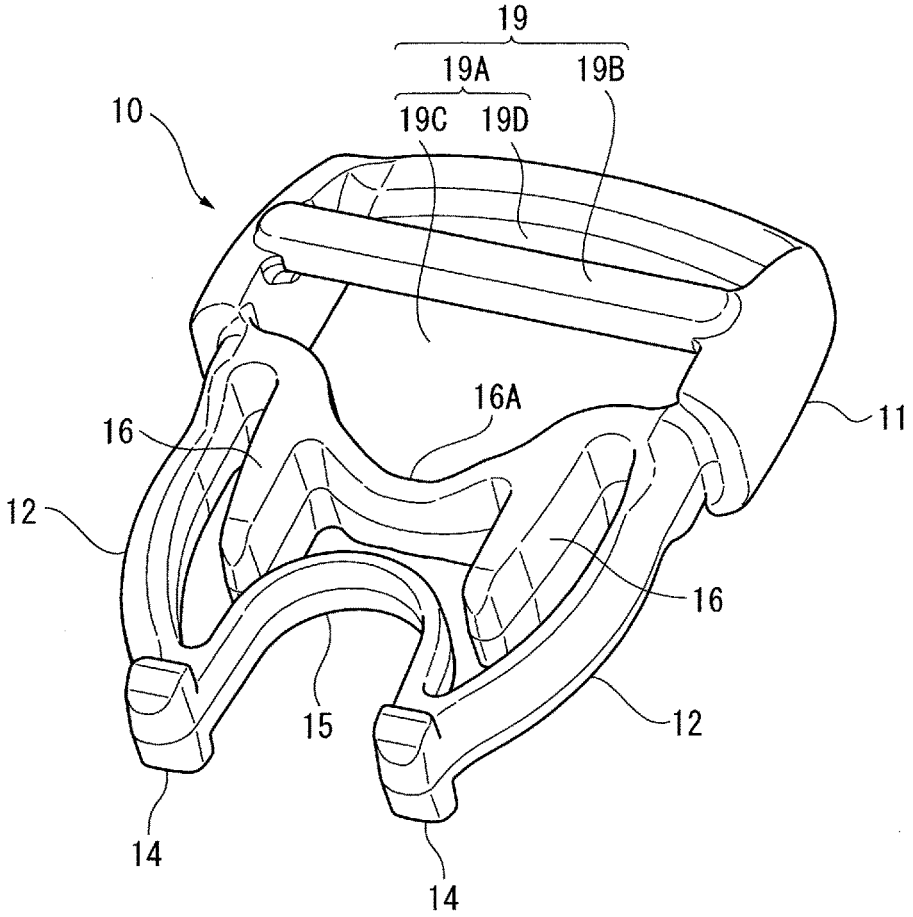
FIG. 2 is a perspective view showing a top surface of a plug according to the first exemplary embodiment.
Figure 3:
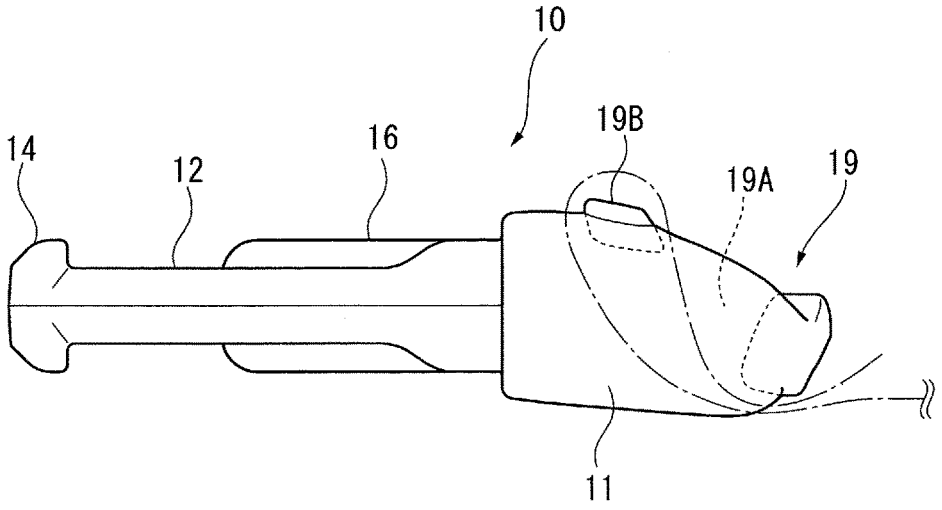
FIG. 3 is a lateral side view showing the plug according to the first exemplary embodiment.

As shown in FIGS. 1 to 3, a side release buckle 1 according to this exemplary embodiment includes a plug 10 and a socket 20 into which the plug 10 is inserted for engagement.

As shown in the figures, the buckle 1 according to this exemplary embodiment is used to couple and separate ends of a string member such as a belt. The buckle 1 includes the plug 10 integrally formed of a synthetic resin and the socket 20 also integrally formed of a synthetic resin. The plug 10 and the socket 20 may be formed by other materials such as metal in addition to a synthetic resin by other forming methods in addition to molding.

In FIGS. 1 and 2, an entirety of the plug 10 is integrally formed of a synthetic resin by molding. The plug 10 includes a base 11 having a belt attachment 19 and a pair of legs 12, and an engaging portion 14 formed in each of the legs 12.

The legs 12 extend in a length direction of the base 11 (an insertion direction of the plug 10 to the socket 20, i.e., in a vertical direction in FIG. 1) from both sides of the base 11 in a width direction (a direction orthogonal to the insertion direction of the plug 10 to the socket 20 and a top-bottom direction of the socket 20, i.e., a horizontal direction in FIG. 1). The legs 12 are parallel with each other. Portions from the centers to the tip ends of the legs 12 are elastically deformable in a direction separating from each other or in a direction approaching each other (the above-described width direction).

The pair of legs 12 are gradually inclined in the direction approaching each other toward the tip ends of the legs 12 in the insertion direction and are curved with a predetermined clearance, so that the legs 12 can receive elastic deformation force as a whole.

The engaging portion 14 is formed as a projection extending from the tip end of each of the legs 12 in a vertical direction (the top-bottom direction of the socket 20). The tip end of each of the legs 12 is T-shaped in a lateral side view. In other words, the engaging portion 14 is formed at the tip end of each of the legs 12. A dimension in a top-bottom direction (height) of the engaging portion 14 is set larger than a height of each of the legs 12.

The belt attachment 19 is formed in a middle area of the base 11.

As shown in FIG. 2, the belt attachment 19 includes a string attachment hole 19A as a string attachment portion into a center of which an end of the string member is inserted for engagement, and a connecting bar 19B bridging over the string attachment portion in the middle thereof. The connecting bar 19B divides the string attachment hole 19A into a front hole 19C in the insertion direction and a rear hole 19D in the insertion direction. With this arrangement, a length of the string member can be adjusted by inserting the string member through the string attachment hole 19A and winding the string member around the connecting bar 19B.

In FIG. 2, the tip ends of the pair of legs 12 are connected by a U-shaped connecting portion 15.

Both sides of the connecting portion 15 extend from the engaging portions 14 of the tip ends of the legs 12 toward the belt attachment portion 19, respectively, and approach each other to be connected in a U-shape. With this connecting portion 15, the pair of legs 12 can be prevented from being excessively pulled outward by an external force. A pair of guided portions 16 are provided between the pair of legs 12.

As shown in FIG. 3, each of the guided portions 16 has the same height as that of the engaging portion 14 of the tip end of each of the legs 12. An upper periphery of each of the guided portions 16 projects upward beyond an upper periphery of each of the legs 12 while a lower periphery of each of the guided portions 16 projects downward beyond a lower periphery of each of the legs 12.

The engaging portions 14 and the guided portions 16 are guided by guide surfaces 30 and undulations 26 (both described later) formed in a central portion of the socket 20 so that the plug 10 is guided to an appropriate position in an insertion operation.

As shown in FIG. 2, the guided portions 16 are connected to each other via a connecting frame 16A near the base 11. The connecting frame 16A connects opposing portions of the guided portions 16 near the base 11. A middle portion of the connecting frame 16A is curved in a manner to project in the insertion direction of the plug 10. A height of the middle portion of the connecting frame 16A in a top-bottom direction is set lower than a height of each of the guided portions 16. The height of the middle portion is increased toward ends of the connecting frame 16A and reaches the height of each of the guided portions 16 at the ends of the connecting frame 16A. Thus, top and bottom surfaces of the connecting frame 16A are gradually dented at respective centers thereof. This profile corresponds to the outline of a convex 26B formed on an inner surface of a body 21 (described later).

Figure 4:
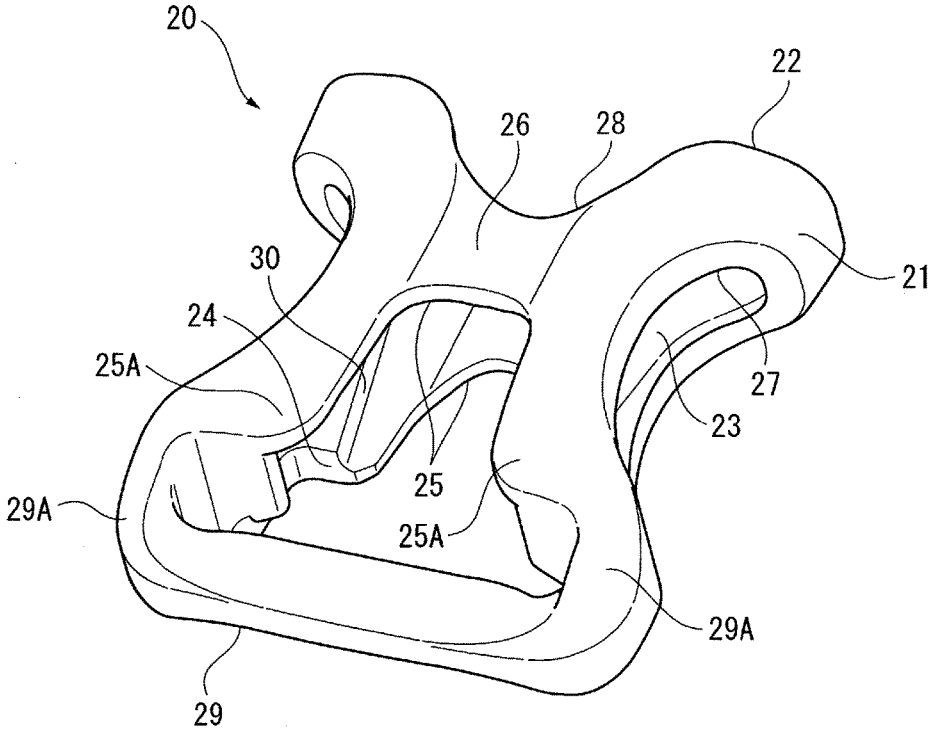
FIG. 4 is a perspective view showing a top surface of a socket according to the first exemplary embodiment.

In FIGS. 1 and 4, an entirety of the socket 20 is integrally formed of a synthetic resin by molding. The socket 20 includes: the hollow cylindrical body 21 including a belt attachment 29 and an insertion opening 22; a housing space 23 being formed in the body 21 and capable of housing the legs 12 of the plug 10 to be inserted through the insertion opening 22; and an engaged portion 24 being formed in the body 21 and engageable with the engaging portion 14. In order to release the engagement of the engaging portions 14 and the engaged portions 24, a manipulation opening 27 is formed on the body 21. The manipulation opening 27 is formed on each of lateral sides of the body 21 and communicates with the housing space 23 inside the body 21.

As shown in FIG. 4, the engaged portion 24 is provided as steps respectively formed at four positions inside the housing space 23 and facing the belt attachment 29 (in a direction opposite to the insertion opening 22). Two of the four step-shaped engaged portions 24 are formed on an inner side of the bottom surface of the body 21 and face the housing space 23 and side portions 29A of the belt attachment 29 of the body 21. The other two of the four steps, which are formed on an inner side of the top surface of the body 21 in the same manner as the above, are covered by projections 25A on the top surface of the body 21. The engaged portion 24 is provided by a pair of steps among the four steps, the pair of steps respectively formed on the top and bottom surfaces and facing each other. In the socket 20 according to this exemplary embodiment, the engaged portions 24 lining in a width direction are made in a pair and correspond to the engaging portions 14 formed in the pair of legs 12.

As shown in FIGS. 1 and 4, the manipulation opening 27 is positioned to expose a middle portion of each of the legs 12 inserted through the insertion opening 22. By pressing inward the legs 12 exposed out of the manipulation openings 27, the pair of legs 12 are elastically deformed to approach each other and the engaging portions 14 are released from the engaged portions 24, so that the mutual engagement is released.

Figure 5:
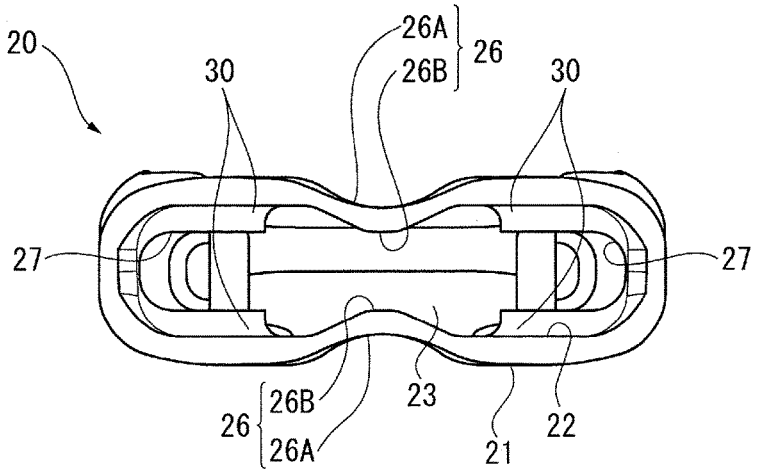
FIG. 5 is a front view showing an insertion opening of the socket according to the first exemplary embodiment.

As shown in FIGS. 4 and 5, a pair of guide surfaces 30 are formed in the housing space 23 to guide the engaging portions 14 to the engaged portions 24 for engagement.

The guide surfaces 30 are defined in steps formed continuously from the vicinity of both ends of the insertion opening 22 to the engaged portions 24 along the top and bottom surfaces of the body 21. When the legs 12 are inserted through the insertion opening 22, the guide surfaces 30 serve as a guiding mechanism for guiding the engaging portions 14 formed at the tip ends of the legs 20 to the engaged portions 24. In other words, the engaging portions 14, which are located at the tip ends of the legs 12 inserted through the insertion opening 22, are guided by the guide surfaces 30 and are squeezed to approach each other due to the elastic deformation of the pair of legs 12. When the engaging portions 14 reach the engaged portions 24, the legs 12 elastically deformed by the guide surfaces 30 are recovered, so that the engaging portions 14 fit in the engaged portions 24 for mutual engagement.

Figure 8:
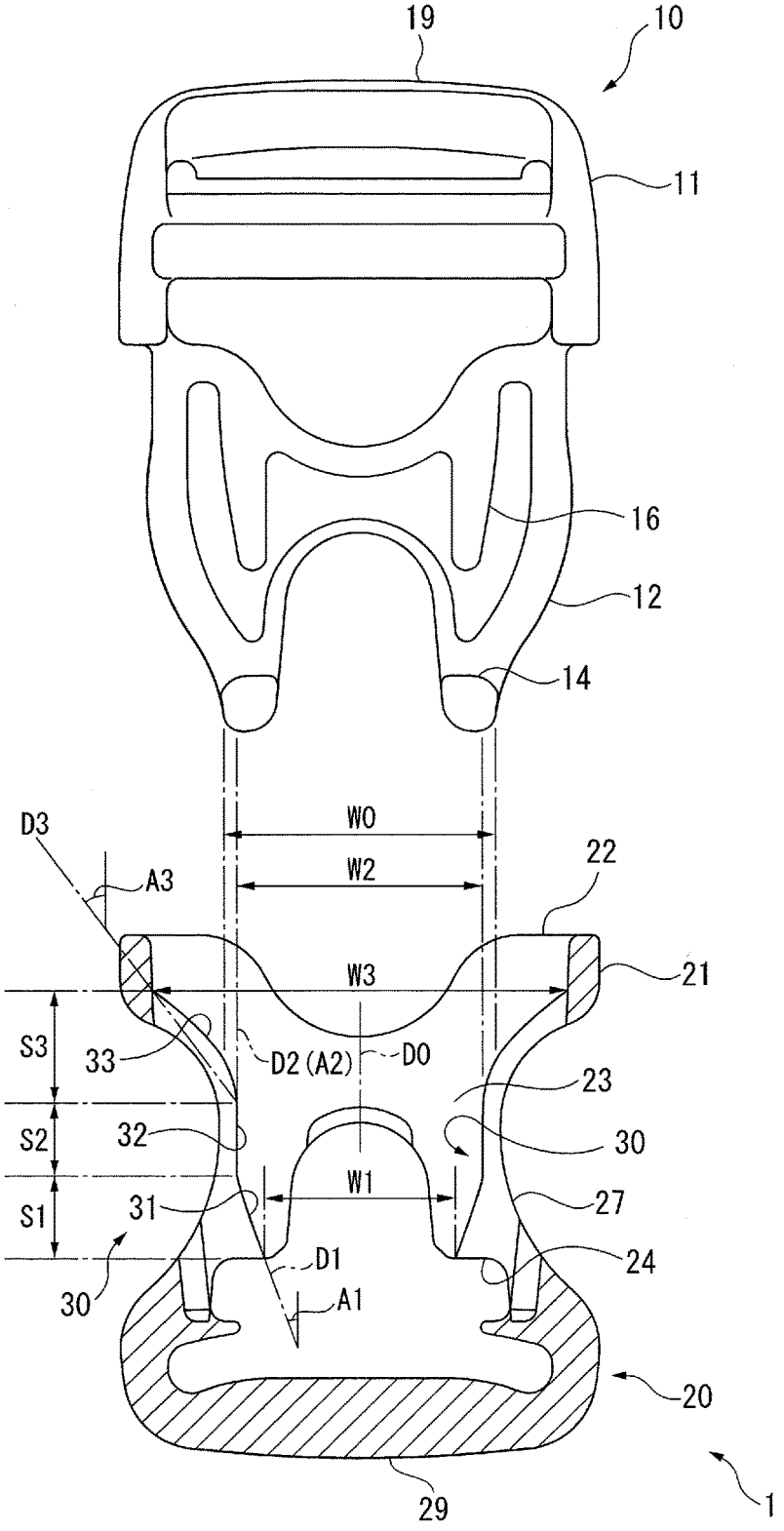
FIG. 8 is a sectional view showing guide surfaces according to the first exemplary embodiment.

As shown in FIG. 8, the pair of guide surfaces 30 are formed continuously from the engaged portions 24 to the vicinity of the insertion opening 22, and each include a squeezing portion 31, a guiding portion 32 and an introducing portion 33.

The squeezing portion 31 of each of the guide surfaces 30 is formed over a section S1 adjacent to the engaged portion 24 of the guide surface 30, and is linearly formed as a whole in a direction D1 intersecting with an insertion direction D0 of the plug 10 at an inclination angle A1. The inclination angle A1 is determined such that the squeezing portion 31 is inclined to deform the legs 12 and to squeeze the pair of engaging portions 14 when the plug 10 is inserted into the housing space 23 through the insertion opening 22.

Ends of such a pair of squeezing portions 31, which are adjacent to the engaged portions 24, are opposed to each other at an interval W1. The interval W1 is sufficiently narrower than the interval between the pair of engaging portions 14 of the plug 10 when no load is applied to the plug 10, and falls within a range such that the legs 12 are deformed and the pair of engaging portions 14 are squeezed. Thus, when the plug 10 is inserted into the housing space 23 through the insertion opening 22, the pair of engaging portions 14 are squeezed due to the inclination of the squeezing portions 31. When reaching the engaged portions 24, the engaging portions 14 are released from the squeezing, and are again separated from each other to fit in the pair of engaged portions 24.

The guiding portion 32 of each of the guide surfaces 30 is formed over a section S2 adjacent to the squeezing portion 31 of the guide surface 30, and is linearly formed as a whole in a direction D2 being parallel with the insertion direction D0 of the plug 10 (i.e., an inclination angle A2=0). Thus, such an opposed pair of guiding portions 32 are parallel with each other and are spaced from each other at an interval W2. A connecting portion between the guiding portion 32 and the squeezing portion 31 of each of the guide surfaces 30 is formed in an arc smoothly continuous with the guiding portion 32 and the squeezing portion 31 so that the engaging portions 14 can smoothly slide irrespective of the difference between the inclination angle A2 and the inclination angle A1.

The introducing portion 33 of each of the guide surfaces 30 is formed over a section S3 adjacent to the guiding portion 32 of the guide surface 30. The introducing portion 33 is smoothly continuous with the guiding portion 32 and is formed in an arc so that the interval between the introducing portions 33 of the pair of guide surfaces 30 reaches the maximum width of the insertion opening 22.

Since each of the introducing portions 33 is formed in an arc, a direction D3 of the introducing portion 33 cannot be simply determined. Accordingly, the direction D3 may be approximately defined by a direction of a straight line connecting an end of the introducing portion 33 near the guiding portion 32 and an end of the introducing portion 33 near the insertion opening 22.

The direction D3 of the introducing portion 33 intersects with the insertion direction D0 of the plug 10 at an inclination angle A3. The inclination angle A3 is larger than the inclination angle A1 of the squeezing portion 31 because the introducing portion 33 is intended not to squeeze the engaging portion 14 but to guide the engaging portion 14 to the guiding portion 32.

The outermost sides of the pair of engaging portions 14 are spaced from each other at an interval W0, which is larger than the interval W2 between the guiding portions 32. Thus, when the introducing portions 33 lead the pair of engaging portions 14 to the guiding portions 32, the pair of engaging portions 14 are squeezed by the introducing portions 33. Although the introducing portions 33 are each curved in an arc and have the large inclination angle A3 as a whole, the introducing portions 33 can squeeze the pair of engaging portions 14 because the introducing portions 33 have a small inclination angle in the vicinity of the ends thereof continuing with the guiding portions 32. In this manner, the pair of engaging portions 14 are introduced to the guiding portions 32 while being slightly squeezed. The pair of engaging portions 14 slide on the guiding portions 32 with a slight contact pressure to be guided to the squeezing portions 31.

The body 21 includes an undulation 26 continuously formed in an insertion direction of the legs 12 substantially at a center of each of the top and bottom surfaces of the body 21.

As shown in FIG. 5, the undulation 26 is provided by a concave 26A formed on an outer surface of the body 21 and a convex 26B formed on an inner surface of the body 21 along the concave 26A. A thickness of a portion defined by the concave 26A and the convex 26B is the same as those of other portions of the body 21. In other words, the body 21 is cross-sectionally a corrugated plate provided by curving a portion of a flat plate.

The undulation 26 is formed on each of the top and bottom surfaces of the body 21, so that the body 21 is formed like a corrugated plate curved in a direction in which the centers of the top and bottom surfaces facing each other approach. This arrangement can secure strength substantially at the centers where press force working in the top-bottom direction is most likely to be applied and cracks are likely to generate, and is effective for preventing crush and cracks.

The undulations 26 are positioned on the top and bottom surfaces of the body 21 to correspond to each other. The convexes 26B of the undulations 26 are positioned to fit in respective dents on the top and bottom surfaces of the connecting frame 16A between the legs 12 inserted into the housing space 23. A gap between the convexes 26B is set smaller than the height of each of the engaging portions 14 and the height of each of the guided portions 16 (the dimension in the top-bottom direction). When the legs 12 are inserted, the engaging portions 14 and the guided portions 16 are guided along the undulation 26. The undulation 26 provides a guiding function to suitably guide the engaging portions 14 to the engaged portions 24 while adjusting a posture of the plug 10. At this time, since being provided with the dents on the top and bottom surfaces, the connecting frame 16A between the guided portions 16 can be inserted into the gap of the convexes 26B without interference with the convexes 26B.

A height of the housing space 23 into which each of the guided portions 16 is introduced is set equal to the height of the guided portion 16. While the guided portions 16 remain inserted in the housing space 23, when the socket 20 is pressed in the top-bottom direction, the guided portions 16 support the socket 20 and prevent excessive deformation such as crush in the top-bottom direction.

Figure 6:
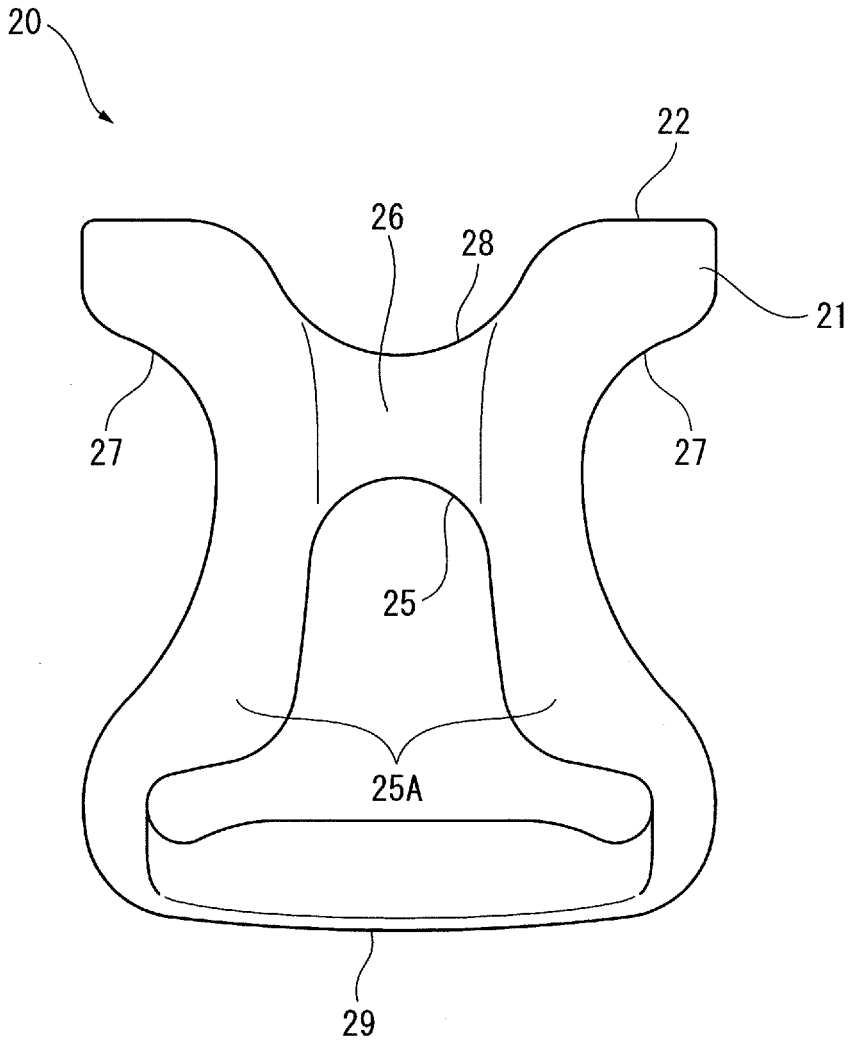
FIG. 6 is a plan view showing the top surface of the socket according to the first exemplary embodiment.
Figure 7:
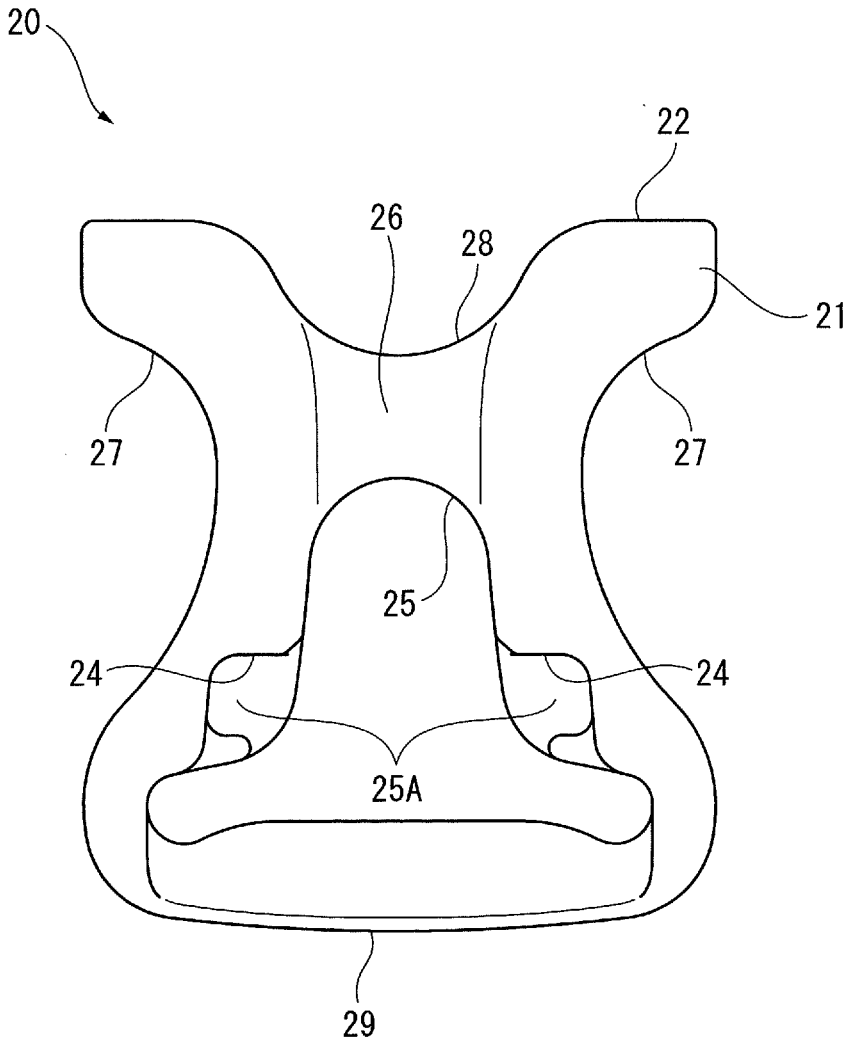
FIG. 7 is a plan view showing a bottom surface of the socket according to the first exemplary embodiment.

As shown in FIGS. 6 and 7, on each of the top and bottom surfaces of the body 21, a cutout 28 extending along the undulation 26 is provided by forming the center of a widthwise edge of the insertion opening 22 in an arc dented toward the belt attachment 29 and a cutout 25 extending along the undulation 26 is provided by forming the center of a widthwise edge of a belt-insertion opening near the belt attachment 29 in an arc dented toward the insertion opening 22.

The cutout 25 is a deep U-shaped cutout extending from the belt attachment 29. The cutout 28 is a shallow C-shaped cutout extending from the insertion opening 22. The most inward parts of the cutouts 25 and 28 are shaped in an arc.

The outline of a C-shaped edge of the cutout 28 is set equal to the inner shape of the connecting frame 16A formed in the base 11 of the plug 10. With this outline, while the cutout 28 is maximally enlarged, the base 11 is not exposed more than necessary.

The outline of a U-shaped edge of the cutout 25 is set equal to the outer profile of the legs 12 and the connecting portion 15. As described above, the tip ends of the pair of legs 12 are connected to each other by the connecting portion 15, the inside of which is in a U-shape as a whole. The outline of the cutout 25 is formed in line with this shape. With this outline, while the cutout 25 is maximally enlarged, the legs 12 and the connecting portion 15 are not exposed.

In the cutout 25 formed on the top surface of the body 21 among the cutouts 25, portions facing both edges of the belt attachment portion 29 are provided as projections 25A projecting along the belt attachment 19. The above-described engaged portions 24 near the top surface are covered by the projections 25A. The projections 25A prevent the belt inserted in the belt attachment 29 from being improperly lifted up.

The cutout 25 formed on the bottom surface of the body 21 includes no portion corresponding to the projections 25A. A part of an edge of the cutout 25 is formed along the step of each of the engaged portions 24, so that the engaged portions 24 are exposed from the bottom surface of the body 21.

As shown in FIG. 4, a height of the side portions 29A of the belt attachment 29 of the body 21 is larger than that of a belt-winding portion of the belt attachment 29, so that a sufficient connection strength is attained.

In this exemplary embodiment, when the legs 12 of the plug 10 are inserted through the insertion opening 22 of the socket 20 and are pushed in the insertion direction D0, the engaging portions 14 formed at the tip ends of the legs 12 are guided by the guide surfaces 30 to fit in the engaged portions 24. Specifically, the engaging portions 14 are initially guided to the guiding portions 32 by the introducing portions 33 while being slightly squeezed. When the plug 10 is further pushed, the engaging portions 14 are guided along the guiding portions 32 to be inserted further inside the socket 20. The engaging portions 14 are then sufficiently squeezed by the squeezing portions 31 to fit in the engaged portions 24.

The guiding portions 32, which are parallel with each other at the interval W2, are spaced from each other wider than the squeezing portions 31 as a whole. Further, the inclination angle A2 of each of the guiding portions 32 relative to the insertion direction D0 is constantly equal to 0. Thus, the engaging portions 14 are not so strongly squeezed by the guiding portions 32 as by the squeezing portions 31. Assumably, even though the engaging portions 14 are guided to the guiding portions 32 while being slightly squeezed by the introducing portions 33, the engaging portions 14 can slide with a slight resistance. Thus, while being guided by the guiding portions 32, the engaging portions 14 can slide with less resistance. Thus, it is possible to significantly lower a possibility of suffering from a deformation tendency resulting from the halfway stopping of the engaging portions 14 and generating a squeak noise.

The inclination angle A1 and the interval W1 of the squeezing portions 31 are determined such that the engaging portions 14 having been guided by the guiding portions 32 can be sufficiently squeezed to fit in the engaged portions 24. On the squeezing portions 31, the engaging portions 14 may stop halfway, which results in a deformation tendency, and may generate a squeak noise. However, since the introducing portions 33 and guiding portions 32 occupy a large part of the distance from the insertion opening 22 to the engaged portions 24 to reduce a part corresponding to the squeezing portions 31, it is possible to lower a possibility of suffering from a deformation tendency resulting from the halfway stopping of the engaging portions 14 and generating a squeak noise as a whole.

In particular, in this exemplary embodiment, the section S1 for the squeezing portions is, for instance, at most one third as long as the distance from the insertion opening 22 to the engaged portions 24. Such sectional distribution can reduce the ratio of the squeezing portions 31 to the distance from the insertion opening 22 to the engaged portions 24. Thus, even though the engaging portions 14 inevitably stop halfway on the squeezing portions 31, it is possible to significantly lower a possibility of suffering from a deformation tendency resulting from the halfway stopping and generating a squeak noise as a whole.

The introducing portion 33 and the guiding portion 32 of each of the guide surfaces 30 are partly formed in an arc along the manipulation opening 27 of the socket 20. Thus, since it is not necessary to provide an extra thickness to the body 21 of the socket 20, a material can be efficiently usable.

In this exemplary embodiment, since the undulations 26 are formed in the insertion direction of the legs 12, the undulations 26 are allowed to have no interference with an insertion operation of the legs 12 and to have a guiding function for the engaging portions 14 of the legs 12 and the guided portions 16.

Further, since the undulations 26 are interposed between portions for housing the legs 12 in the housing space 23 in a projecting manner, when the pair of legs 12 are inserted into the housing space 23, the legs 12 enter both sides of the undulations 26, so that a thickness (a dimension in the top-bottom directions of the buckle) of each of the legs 12 and the undulations 26 can be increased without mutual interference between the legs 12 and the undulations 26 for effectively ensuring strength.

Moreover, the undulations 26 also serve as a guide to guide the engaging portions 14 to the engaged portions 24 when the legs 12 are inserted therein, so that the plug 10 and the socket 20 can be easily and reliably engaged with each other.

Second Exemplary Embodiment

Figure 9:
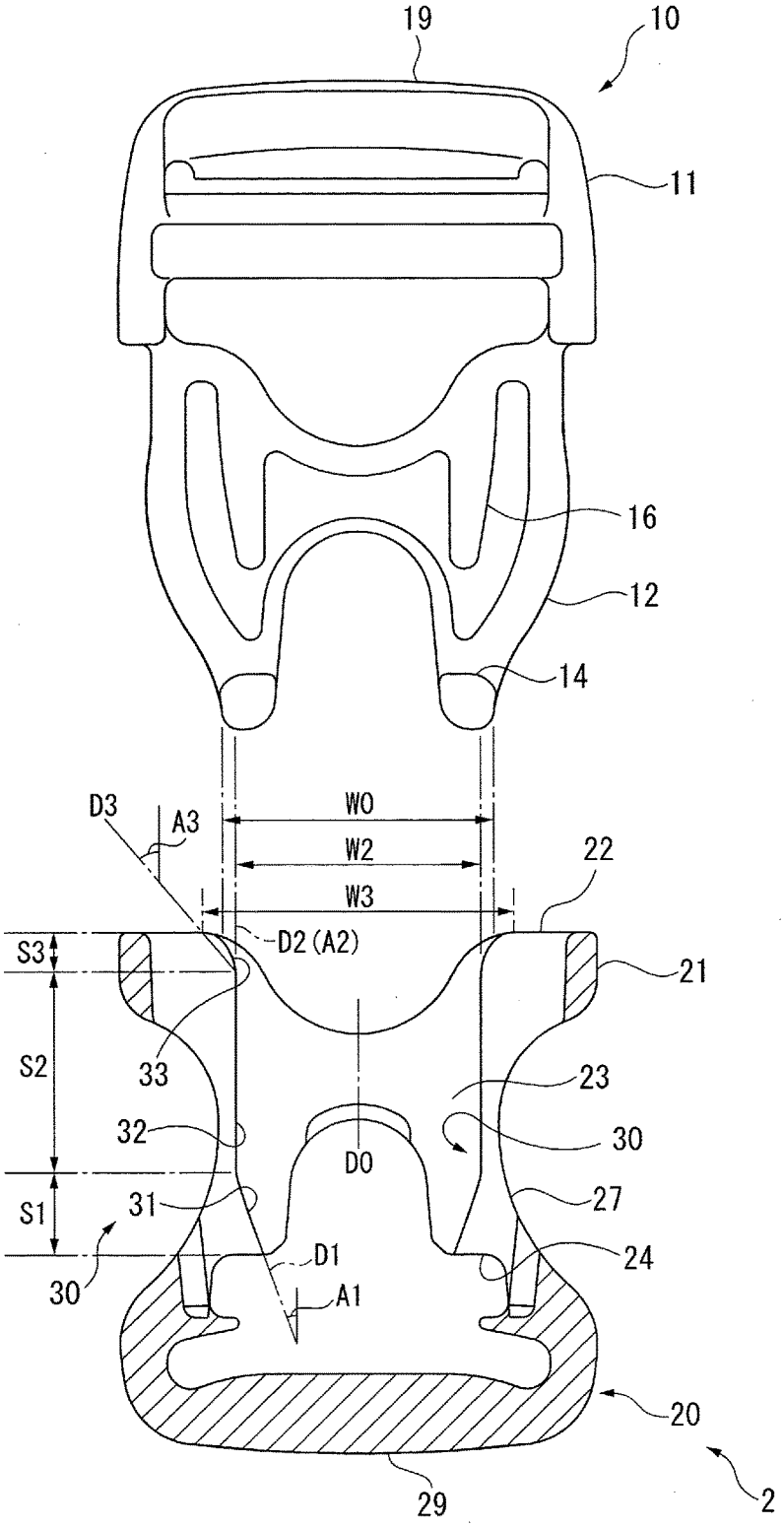
FIG. 9 is a sectional view showing guide surfaces according to a second exemplary embodiment of the invention.

FIG. 9 shows a second exemplary embodiment of the invention.

A side release buckle 2 according to this exemplary embodiment includes the same plug 10 and socket 20 as those in the first exemplary embodiment. It should be noted that this exemplary embodiment is different from the first exemplary embodiment in the sectional distribution for the guide surfaces 30 in the socket 20.

In this exemplary embodiment, as shown in FIG. 9, the section S2 for the guiding portions 32 is increased while the section S3 for the introducing portions 33 is correspondingly reduced.

The introducing portions 33 are each formed in an arc and have the inclination angle A3 in the same manner as in the first exemplary embodiment, but the interval W3 is considerably reduced.

The pair of guiding portions 32 are parallel with each other and the direction D2 thereof is equal to the insertion direction D0 (i.e., the inclination angle A2 is equal to 0) in the same manner as in the first exemplary embodiment.

The section S1, the direction D1 and the inclination angle A1 of the squeezing portions 31 are not changed.

This exemplary embodiment also provides the same advantages as those of the first exemplary embodiment. Further, since the section for the guiding portions 32 is increased, the attitude of the plug 10 relative to the socket 20 can be stabilized at an earlier phase to facilitate the insertion of the engaging portions 14. It should be noted that since the interval W3 is considerably reduced, in order to introduce the pair of engaging portions 14 to the guiding portions 32, it is necessary to, for instance, seek for the guiding portion 32 within the range of the interval W3.

Third Exemplary Embodiment

Figure 10:
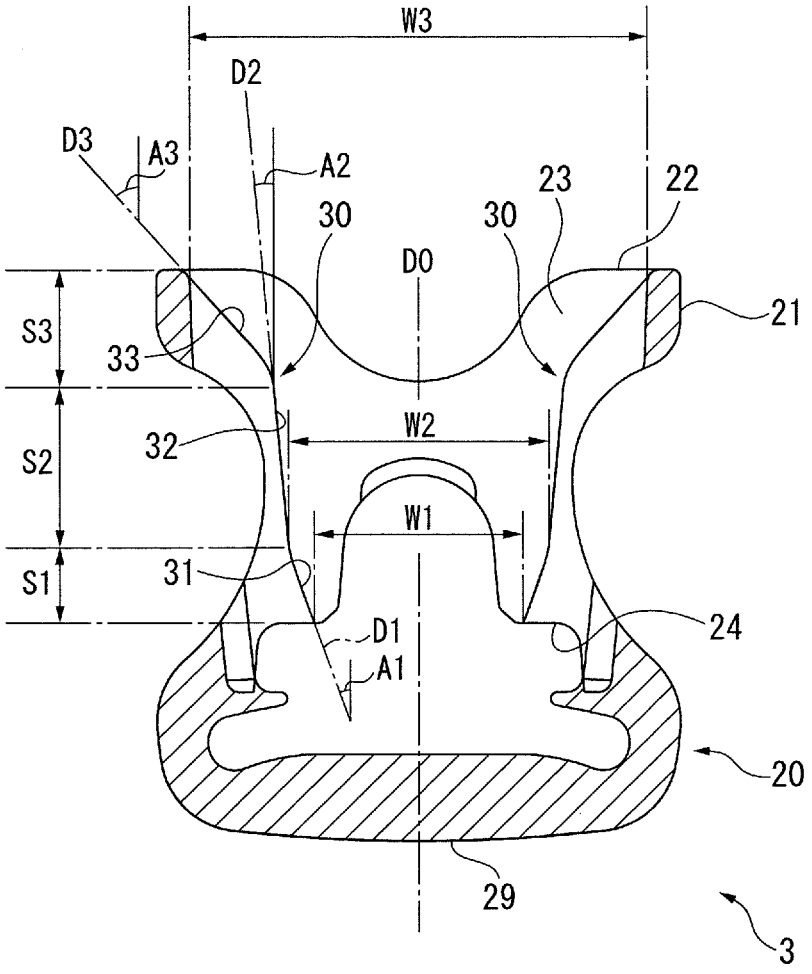
FIG. 10 is a sectional view showing guide surfaces according to a third exemplary embodiment of the invention.

FIG. 10 shows a third exemplary embodiment of the invention.

A side release buckle 3 according to this exemplary embodiment includes the same plug 10 and socket 20 as those in the first exemplary embodiment. It should be noted that this exemplary embodiment is different from the first exemplary embodiment in the respective shapes and arrangements of the introducing portions 33 and the guiding portions 32.

While the introducing portions 33 according to the first exemplary embodiment are each formed in an arc, the introducing portions 33 according to this exemplary embodiment are linearly formed. Further, according to this exemplary embodiment, the introducing portions 33 each have an end located on the edge of the insertion opening 22, and linearly extend into the housing space 23 along the direction D3 intersecting with the insertion direction D0 at the inclination angle A3 to be continuous with the guiding portions 32.

While the guiding portions 32 according to the first exemplary embodiment are parallel with each other, the pair of guiding portions 32 according to this exemplary embodiment linearly extend along the direction D2 intersecting with the insertion direction D0 at the inclination angle A2 to define a slightly tapered shape.

In this exemplary embodiment, since the section for the guiding portions 32 is increased, the attitude of the plug 10 relative to the socket 20 can be stabilized at an earlier phase to facilitate the insertion of the engaging portions 14.

This exemplary embodiment also provides the same advantages as those of the first exemplary embodiment.

Fourth Exemplary Embodiment

Figure 11:
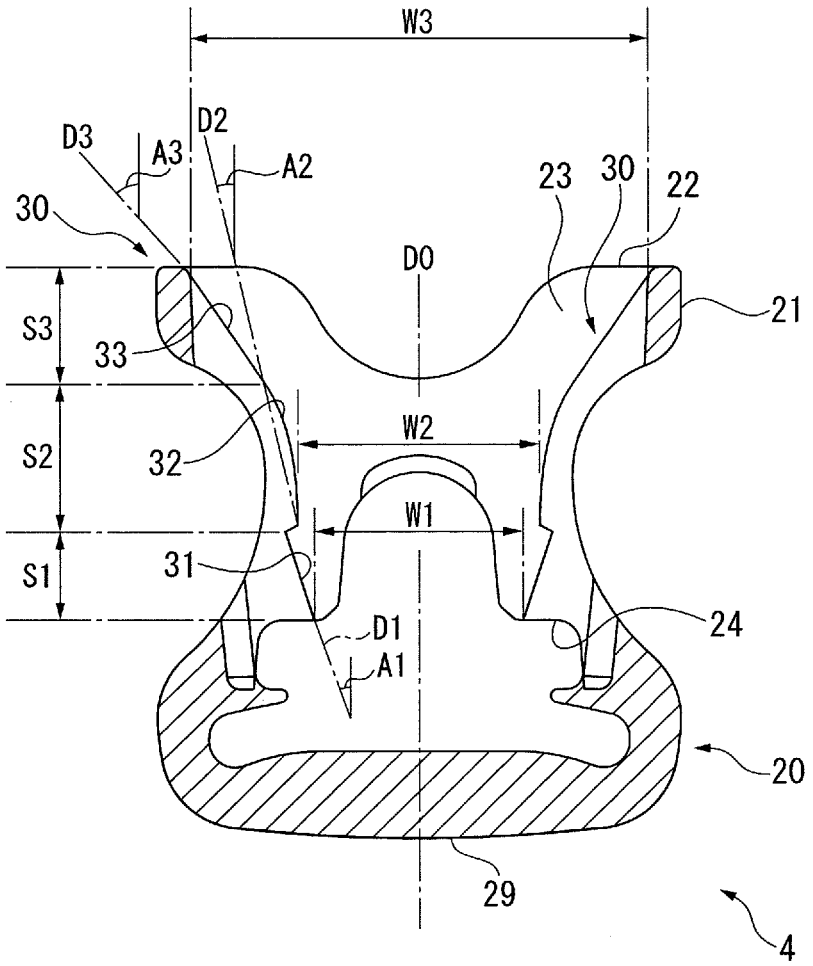
FIG. 11 is a sectional view showing guide surfaces according to a fourth exemplary embodiment of the invention.

FIG. 11 shows a fourth exemplary embodiment of the invention.

A side release buckle 4 according to this exemplary embodiment includes the same plug 10 and socket 20 as those in the first exemplary embodiment. It should be noted that this exemplary embodiment is different from the first exemplary embodiment in the respective shapes and arrangements of the introducing portions 33 and the guiding portions 32.

Although the introducing portions 33 according to the first exemplary embodiment are each formed in an arc, the introducing portions 33 according to this exemplary embodiment are linearly formed. Further, according to this exemplary embodiment, the introducing portions 33 each have an end located on the edge of the insertion opening 22, and linearly extend into the housing space 23 along the direction D3 intersecting with the insertion direction D0 at the insertion angle A3 to be continuous with the guiding portions 32. The above features are the same as those in the third exemplary embodiment.

While the guiding portions 32 according to the first exemplary embodiment are parallel with each other and linearly extend, the guiding portions 32 according to this exemplary embodiment are each formed in an arc and have the inclination angle A2 relative to the insertion direction D0. Since each of the guiding portions 32 is formed in an arc, the direction D2 may be approximately defined by a direction of a straight line connecting an end of the guiding portion 32 near the introducing portion 33 and an end of the guiding portion 32 near the squeezing portion 31.

Further, according to this exemplary embodiment, each of the guiding portions 32 is not continuous with the squeezing portion 31. Specifically, the ends of the guiding portions 32 near the squeezing portions 31 are opposed to each other at the interval W2, which is smaller than an interval between ends of the squeezing portions 31 near the guiding portions 32. Each of the guiding portions 32 and the following squeezing portion 31 is coupled to each other in a crank shape, so that the sliding motion of the engaging portions 14 from the guiding portion 32 to the squeezing portion 31 is easily acceptable, but the inverse motion is restrained by the crank-like portion.

This exemplary embodiment also provides the same advantages as those of the first exemplary embodiment. Further, even when the engaging portions 14 come out of the engaged portions 24, the crank-like portions between the guiding portions 32 and the squeezing portions 31 serve to restrain the engaging portions 14, so that an accidental separation of the plug 10 can be reliably prevented.

Fifth Exemplary Embodiment

Figure 12:
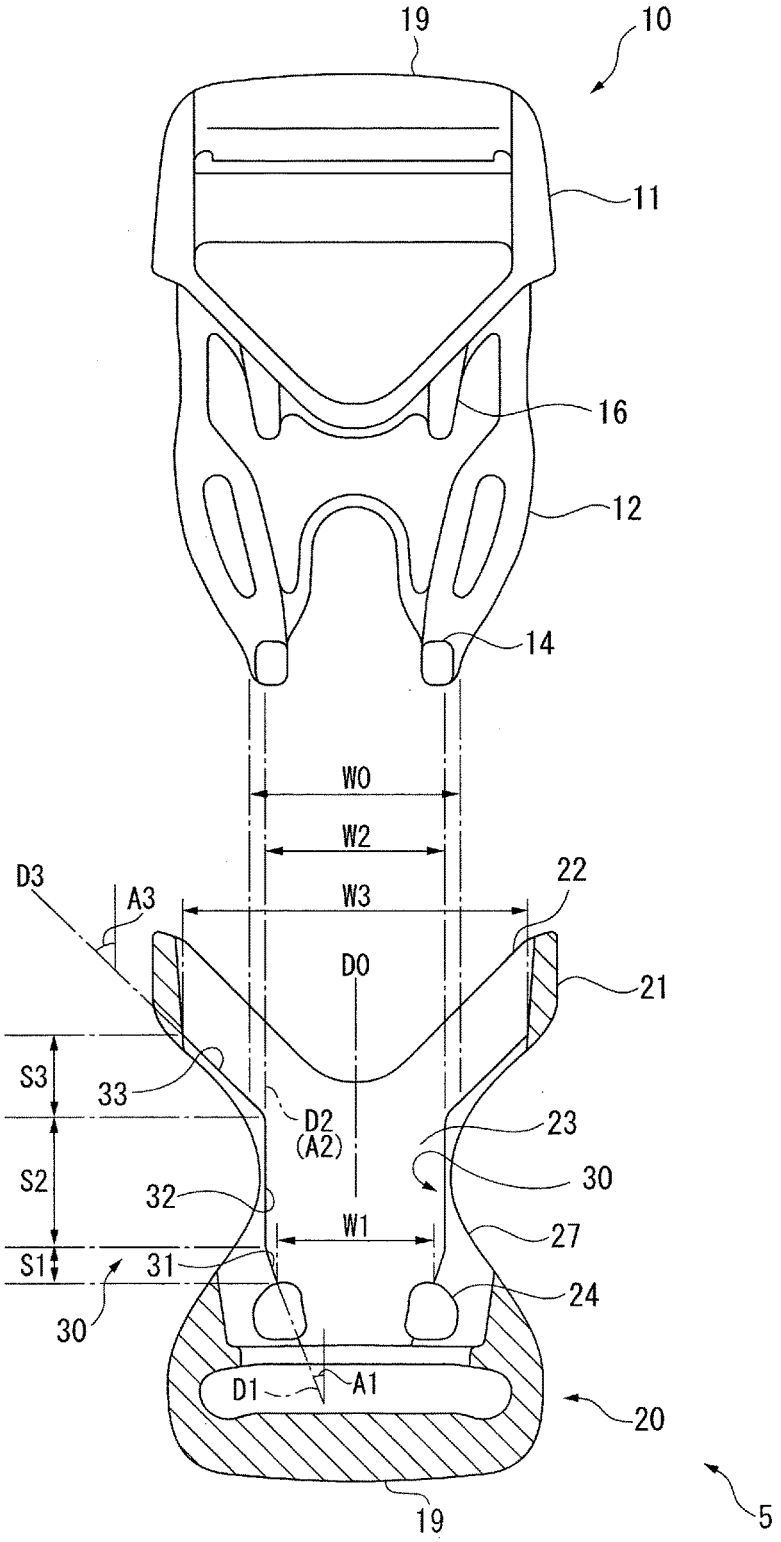
FIG. 12 is a sectional view showing guide surfaces according to a fifth exemplary embodiment of the invention.

FIG. 12 shows a fifth exemplary embodiment of the invention.

A side release buckle 5 according to this exemplary embodiment includes the plug 10, the socket 20 and the guide surfaces 30 as in the first exemplary embodiment. It should be noted that the plug 10 and the socket 20 according to this exemplary embodiment are different from those of the first exemplary embodiment in the outline of the body 21, the shape of the legs 12, or the like.

According to this exemplary embodiment, the guide surfaces 30 each include linear portions, i.e., the introducing portion 33, the guiding portion 32 and the squeezing portion 31. The introducing portions 33 are formed over the section S3, the direction thereof is D3, the inclination angle thereof is A3, and the interval therebetween is W3. The guiding portions 32 are formed over the section S2, the direction thereof is D2 (which is equal to the insertion direction D0 and thus the guiding portions 32 are parallel with each other), the inclination angle thereof is A2 (which is equal to zero), and the interval therebetween is W2. The direction of the squeezing portions 31 is D1, the inclination angle thereof is A1, and the interval therebetween is W1. Such an arrangement is the same as that of the first exemplary embodiment except that each of the introducing portions 33 is not in an arc.

This exemplary embodiment also provides the same advantages as those of the first exemplary embodiment.

Second Exemplary Embodiment

Figure 13:
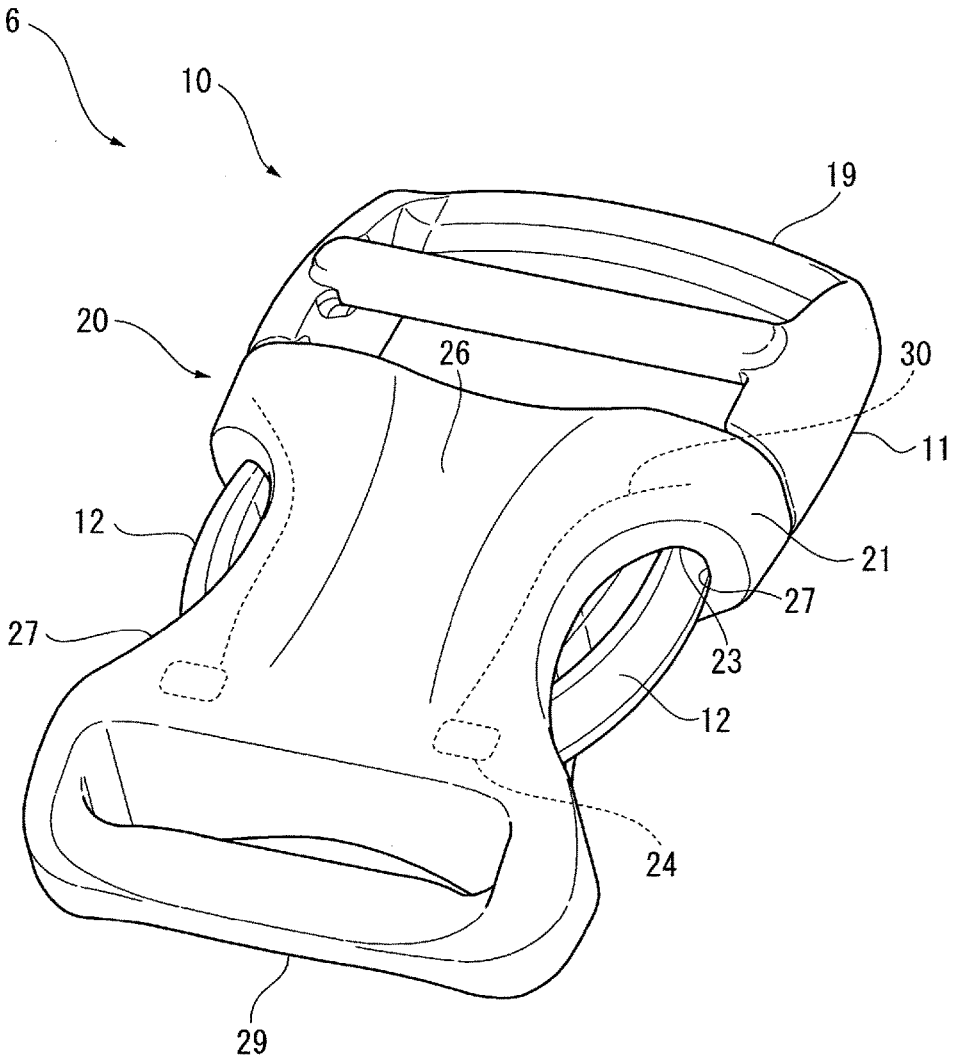
FIG. 13 is a perspective view showing a top surface of a buckle according to a sixth exemplary embodiment of the invention.

FIG. 13 shows a sixth exemplary embodiment of the invention.

A side release buckle 6 according to this exemplary embodiment includes the plug 10, the socket 20 and the guide surfaces 30 as in the first exemplary embodiment. According to this exemplary embodiment, neither the cutout 25 nor 28 as shown in the first exemplary embodiment (see FIG. 1) is formed and a longer undulation 26 is continuously formed from the edge of the insertion opening 22 to the belt attachment 29.

According to this exemplary embodiment, since the cutouts 25 and 28 in FIG. 1 are not provided, the material and the weight of the body 21 are less reduced. However, except for this, the same advantages as those of the first exemplary embodiment can be obtained. Further, the longer undulation 26 according to this exemplary embodiment can enhance the rigidity of the body 21 as compared with the undulation 26 according to the first exemplary embodiment.

Modifications

It should be noted that the invention is not limited to the above arrangements of the exemplary embodiments but encompasses the following modifications.

The distribution ratio of the squeezing portion 31, the guiding portion 32 and the introducing portion 33 in each of the guide surfaces 30 may be altered as needed. Each of the squeezing portion 31, the guiding portion 32 and the introducing portion 33 may be linearly formed or formed in an arc, and the direction, the inclination angle and the interval thereof may be appropriately determined depending on the function thereof.

Although the introducing portion 33 is formed in each of the above exemplary embodiment, the formation of the introducing portion 33 may be omitted. For instance, in the second exemplary embodiment shown in FIG. 9, although the introducing portion 33 is formed in each of the guide surfaces 30 over a narrow section, i.e., the section S3, the formation of the introducing portion 33 may be omitted. Alternatively, the guiding section 32 may be elongated to keep the ratio of the squeezing portion 31 small, thereby achieving the advantages of the invention.

Although each of the guide surfaces 30 is defined in a step in the above exemplary embodiments, the guide surface may be provided by a side surface of a protrusion formed on the inner surface of the socket 20. In other words, the invention only requires that a pair of opposing guide surfaces are formed to guide the pair of engaging portions 14 in such a manner that the engaging portions 14 are gradually squeezed as being closer to the engaged portions 24.

INDUSTRIAL APPLICABILITY

The invention is usable as a side release buckle that connects a belt and is provided with a pair of lock arms on both sides thereof.

EXPLANATION OF CODES

1, 2, 3, 4, 5, 6 side release buckle
10 plug
11 base
12 leg(s)
14 engaging portion(s)
20 socket
21 body
22 insertion opening
23 housing space
24 engaged portion(s)
27 manipulation opening(s)
30 guide surface(s)
31 squeezing portion(s)
32 guiding portion(s)
33 introducing portion(s)
A1 an inclination angle of the squeezing portion(s) relative to an insertion direction
A2 an inclination angle of the guiding portion(s) relative to the insertion direction
A3 an inclination angle of the introducing portion(s) relative to the insertion direction
D0 an insertion direction
D1 a direction of the squeezing portion(s)
D2 a direction of the guiding portion(s)
D3 a direction of the introducing portion(s)
S1 a section for the squeezing portion(s)
S2 a section for the guiding portion(s)
S3 a section for the introducing portion(s)
W0 a distance between the outermost sides of the engaging portions with no load thereon
W1 an interval between the squeezing portions near the engaged portions
W2 an interval between the guiding portions near the engaged portions
W3 an interval between the introducing portions near the insertion opening

The invention claimed is:

1. A side release buckle comprising:
(a) a plug comprising:
a base with a plug belt attachment; and
a pair of legs extending from the base, wherein each of the pair of legs comprises one or more engaging portions; and
(b) a socket comprising:
a body comprising a top side and a bottom side;
a socket belt attachment;
an insertion opening through which the pair of legs is configured to be inserted;
a housing space configured to house the pair of legs when the socket and the plug are in an engaged configuration;
a plurality of engaged portions that are each engageable with one of the one or more engaging portions when the socket and the plug are in the engaged configuration; and
a bottom-side cutout formed by a lower edge of the bottom side of the body and the socket belt attachment,
wherein a first subset of the plurality of engaged portions is provided on an interior surface of the top side of the body and a second subset of the plurality engaged portions is provided on an interior surface of the bottom side of the body at the lower edge of the bottom side, and
wherein, when the socket and the plug are in the engaged configuration, at least a surface of the one or more engaging portions of each of the pair of legs of the plug at a distal end of each of the pair of legs is exposed to the bottom-side cutout.

2. The side release buckle according to claim 1, wherein the top side comprises a top-side cutout between a lower edge of the top side and the socket belt attachment and wherein the bottom-side cutout is larger than the top-side cutout.

3. The side release buckle according to claim 2, wherein, when the plug and the socket are in the engaged configuration, the top side of the body of the socket covers distal ends of the pair of legs and the bottom side of the body of the socket does not cover at least a portion of the distal ends of the one or more engaging portions of the pair of legs.

4. The side release buckle according to claim 1, wherein each of the one or more engaging portions of the pair of legs is a projection that projects from a distal end of the pair of legs.

5. The side release buckle according to claim 1, wherein, when the plug and the socket are in the engaged configuration, the top side of the body of the socket covers at least a portion of the one or more engaging portions of the pair of legs and the bottom side of the body of the socket does not cover the one or more engaging portions of the pair of legs.

6. The side release buckle according to claim 2, wherein at least one of the top-side cutout and the bottom-side cutout is defined by a concave upper edge.

7. The side release buckle according to claim 1, wherein:
each of the pair of legs comprises two engaging portions;
the first subset of the plurality of engaged portions comprises two engaged portions; and
the second subset of the plurality of engaged portions comprises two engaged portions.

8. The side release buckle according to claim 2, wherein the first subset of the plurality of engaged portions is inset relative to the lower edge of the top side of the body.

9. The side release buckle according to claim 1, wherein the top side comprises a top-side cutout between a lower edge of the top side and the socket belt attachment and wherein the bottom-side cutout is larger than the top-side cutout such that, when the plug and the socket are in the engaged configuration, the top side of the body of the socket covers at least a portion of the one or more engaging portions of the pair of legs and the bottom side of the body of the socket does not cover the one or more engaging portions of the pair of legs.

10. The side release buckle according to claim 2, wherein each of the pair of legs of the plug further comprises a distal tip and wherein, when the plug and the socket are in the engaged configuration:

the lower edge of the bottom side is closer to the insertion opening than the distal tips of the pair of legs of the plug; and the lower edge of the top side is generally aligned with the distal tips of the pair of legs of the plug relative to the insertion opening.

11. The side release buckle according to claim 1, wherein the housing space of the socket is configured as a through-hole such that the socket belt attachment is visible when viewed through the insertion opening.

12. A side release buckle comprising:

(a) a plug comprising:

a base with a plug belt attachment; and a pair of legs extending from the base, wherein each of the pair of legs comprises one or more engaging portions; and (b) a socket comprising:

a body comprising a top side and a bottom side;

a socket belt attachment;

an insertion opening through which the pair of legs is configured to be inserted;

a housing space;

a top-side cutout between a lower edge of the top side and the socket belt attachment;

a bottom-side cutout between a lower edge of the bottom side and the socket belt attachment;

two engaged portions positioned on an interior surface of the top side of the body and inset relative to the lower edge of the top side; and two engaged portions positioned on an interior surface of the bottom side of the body and positioned proximate the lower edge of the bottom side, wherein the four engaged portions of the socket are configured to engage the one or more engaging portions of the pair of legs when the plug and socket are in an engaged configuration, and wherein, when the socket and the plug are in the engaged configuration, at least a surface of the one or more engaging portions of each of the pair of legs of the plug at a distal end of each of the pair of legs is exposed.

13. The side release buckle according to claim 12, wherein the bottom-side cutout is larger than the top-side cutout.

14. A side release buckle comprising:

(a) a plug comprising:

a base with a plug belt attachment; and a pair of legs extending from the base, wherein each of the pair of legs comprises one or more engaging portions; and (b) a socket comprising:

a body comprising a top side and a bottom side;

a socket belt attachment;

an insertion opening through which the pair of legs is configured to be inserted;

a housing space;

a top-side cutout between a lower edge of the top side and the socket belt attachment;

a bottom-side cutout between a lower edge of the bottom side and the socket belt attachment; and a plurality of engaged portions configured to engage the one or more engaging portions of the pair of legs when the plug and socket are in an engaged configuration, wherein the bottom-side cutout is larger than the top-side cutout such that, when the plug and the socket are in the engaged configuration, the top side of the body of the socket covers at least a portion of the one or more engaging portions of the pair of legs and the bottom side of the body of the socket does not cover the one or more engaging portions of the pair of legs, and wherein, when the socket and the plug are in the engaged configuration, at least a surface of the one or more engaging portions of each of the pair of legs of the plug at a distal end of each of the pair of legs is exposed.

15. The side release buckle according to claim 14, wherein the plurality of engaged portions comprises:

two engaged portions positioned on an interior surface of the top side of the body and inset relative to the lower edge of the top side; and two engaged portions positioned on an interior surface of the bottom side of the body and positioned proximate the lower edge of the bottom side.

16. The side release buckle according to claim 14, wherein each of the one or more engaging portions of the pair of legs is a projection that projects from a distal end of the pair of legs.

17. The side release buckle according to claim 14, wherein each of the plurality of engaged portions is a step formed on an interior surface of the socket.

18. The side release buckle according to claim 14, wherein each of the pair of legs of the plug further comprises a distal tip and wherein, when the plug and the socket are in an engaged configuration:

the lower edge of the bottom side is closer to the insertion opening than the distal tips of the pair of legs of the plug; and the lower edge of the top side is generally aligned with the distal tips of the pair of legs of the plug relative to the insertion opening.

19. The side release buckle according to claim 14, wherein the housing space of the socket is configured as a through-hole such that the socket belt attachment is visible when viewed through the insertion opening.

20. The side release buckle according to claim 14, wherein at least one of the top-side cutout and the bottom-side cutout is defined by a concave upper edge.

21. The side release buckle of claim 1, wherein, when the socket and the plug are in the engaged configuration, a face of the one or more engaging portions of each of the pair of legs of the plug at the distal end of the leg facing the socket belt attachment is exposed to the bottom-side cutout.

22. The side release buckle according to claim 14, wherein, when the socket and the plug are in the engaged configuration, a face of the one or more engaging portions of each of the pair of legs of the plug at the distal end of the leg facing the socket belt attachment is exposed to the bottom-side cutout.

23. The side release buckle according to claim 1, wherein, when the socket and the plug are in the engaged configuration, a pair of mutually facing faces of the pair of legs of the plug are exposed to the bottom-side cutout.

24. The side release buckle according to claim 14, wherein, when the socket and the plug are in the engaged configuration, a pair of mutually facing faces of the pair of legs of the plug are exposed to the bottom-side cutout.

* * * * *